United States Patent [19]

McCullough

[11] Patent Number: 4,701,721

[45] Date of Patent: Oct. 20, 1987

[54] CORE FORMED OF HARD AND SOFT MAGNETIC MATERIALS FOR AN ELECTRICAL RELAY APPARATUS

[75] Inventor: Harold E. McCullough, Blacklick, Ohio

[73] Assignee: American Telephone and Telegraph Company, AT&T Bell Laboratories, Murray Hill, N.J.

[21] Appl. No.: 906,022

[22] Filed: Sep. 11, 1986

[51] Int. Cl.[4] ..... H01H 51/22

[52] U.S. Cl. ..... 335/79; 335/84; 335/281; 335/297

[58] Field of Search ..... 335/78, 79, 84, 85, 335/230, 234, 281, 296, 303, 297

[56] References Cited

U.S. PATENT DOCUMENTS

| | | | |
|---|---|---|---|
| 3,257,586 | 6/1966 | Steingroever | 335/303 |
| 4,322,700 | 3/1982 | Everhart et al. | 335/128 |
| 4,544,904 | 10/1985 | Tarachand | 335/303 X |

*Primary Examiner*—George Harris

*Attorney, Agent, or Firm*—Dwight A. Marshall

[57] ABSTRACT

A miniaturized electromechanical relay (1) having an armature (14) and a spring assembly (13) mounting contacts with a magnetic core member (15) for activating the armature to operate the spring assembly to engage and disengage the contacts. The magnetic core member is formed of hard and soft magnetic powdered materials (150, 151) sintered together to form a fused boundary therebetween for returning magnetic flux generated by the magnetic core pole areas through the fused boundary and the soft magnetic powdered materials.

11 Claims, 4 Drawing Figure

CORE FORMED OF HARD AND SOFT MAGNETIC MATERIALS FOR AN ELECTRICAL RELAY APPARATUS

BACKGROUND OF THE INVENTION

1. Field of the Invention

This invention relates to electrical relay apparatus. In particular, it relates to the construction of miniature electromechanical relays intended for use on circuit boards.

2. Description of the Prior Art

Electromechanical relays have found wide and varied applications in the Telecommunications and Electronics Industry. Although solid state devices have recently replaced relays in many telecommunication and electronic systems, electromechanical relays still offer many advantages in terms of cost and reliability in electrical circuit applications.

Electromechanical relay constructions generally comprise an electromagnetic structure, armature and contact spring assembly wherein the energization of the electromagnetic structure actuates the armature to control the operation of the contact spring assembly thereby engaging and disengaging contacts to control external electrical circuitry coupled with the relay. In modern technology, miniaturization of components have resulted in large numbers of components being mounted on circuit boards. Since space on circuit boards is at a premium, electromechanical relays have been reduced in size so as to require only a small amount of mounting space on a circuit board. As the size of components have decreased and the number of electrical circuits appearing on a circuit board increased, the electrical current requirements for circuit boards have also been decreased thereby requiring the development of low current electromechanical relays.

A problem arises in the development of miniature and low current electromechanical relays in that the operating sensitivity of an electromechanical relay is affected by the reduction in size of the relay electromagnetic structure and the amount of electrical current required to activate the relay armature.

Accordingly, a need exists for a miniature low current electromechanical relay having a high degree of operating sensitivity. A need also exists for an electromechanical relay requiring a small mounting space on a circuit board and a small amount of electrical current to engage and disengage contacts for controlling external electrical circuitry.

SUMMARY OF THE INVENTION

The foregoing problems are solved and a technical advantage is achieved by an electromechanical relay having an armature and a spring assembly mounting contacts with electromagnetic structure for activating the armature and operating the spring assembly to engage and disengage the contacts. The electromagnetic structure has an electromagnetic member having a first region formed of a soft magnetic material and a second region formed of a hard magnetic material superimposed on the soft magnetic material forming pole areas with magnetic flux generated by the pole areas normally returned through the soft magnetic material. Electrical current applied to a coil winding encircling a part of the electromagnetic member magnetizes the soft magnetic material to aid the pole areas in activating the armature.

In accordance with the invention, an electromechanical relay having an armature and a spring assembly has electromagnetic structure for activating the armature and operating the spring assembly to engage and disengage contacts mounted thereon. The electromagnetic structure comprises a generally U-shaped magnetic core member having a first horizontal region formed of a compressed soft magnetic powdered material and a second horizontal region formed of a compressed hard magnetic powdered material sintered to the compressed soft magnetic powdered material forming a fused boundary therewith and a pair of pole areas at each end of the U-shaped magnetic core member. Magnetic flux generated by one pole area is normally returned through the fused boundary and compressed soft magnetic powdered material to the other pole area. Electrical current applied to a coil winding partially encircling the U-shaped magnetic core member magnetizes the compressed soft magnetic powdered material to aid the pole areas to activate the relay armature.

Also in accordance with the invention, an electromechanical relay having an armature and a spring assembly has an electromagnetic structure for activating the armature and bowing the spring assembly to engage and disengage contacts mounted thereon. The electromagnetic apparatus comprises a U-shaped magnetic core member having a generally rectangular shaped cross-sectional area throughout proportioned to have one-half of the area formed of a compressed soft magnetic powdered material and the remaining one-half of the area formed of a compressed hard magnetic powdered material sintered onto the compressed soft magnetic powdered material forming a fused boundary therewith and a pair of vertical pole areas at each end of the U-shaped magnetic core member. Magnetic flux generated by a pole area is normally returned through the fused boundary and compressed soft magnetic powdered material to the other pole area thereby maintaining the armature in a deactivated state. Electrical current applied to a coil winding partially encircling the U-shaped magnetic core member magnetizes the compressed soft magnetic powdered material to aid the pole areas to activate the relay armature to bow the spring assembly.

In further accordance with the invention, a U-shaped magnetic core member for use with an electromechanical latching relay having an armature for bowing a spring assembly to engage and disengage contacts mounted thereon comprises a generally rectangular shaped cross-sectional area throughout proportioned to have twenty to thirty-five percent of the area formed of a compressed soft magnetic powdered material and the remaining eighty to sixty-five percent of the area, respectively, formed of a compressed hard magnetic powdered material sintered onto the compressed soft magnetic powdered material forming a fused boundary therewith and a pair of oversized pole areas at each end of the U-shaped magnetic core member. Magnetic flux normally generated by the oversized pole areas latches the relay armature previously activated by current in a coil winding encircling a section of the U-shaped magnetic core member. A reversed polarity current applied to the coil winding or to a second coil winding partially encircling the U-shaped magnetic core member changes the polarity of the compressed soft powdered magnetic material to oppose the polarity of the oversized pole areas to release the latched armature.

BRIEF DESCRIPTION OF THE DRAWING

The foregoing as well as other objects, features and advantages of the invention will be more apparent from a description of the drawing in which;

FIG. 2 is an exploded view of the operative elements of the electromechanical relay construction set forth in FIG. 1;

FIG. 3 is a perspective view of one embodiment of a magnetic core member for use with the electromechanical relay construction set forth in FIGS. 1 and 2; and FIG. 4 is a perspective view of another embodiment of the magnetic core member set forth in FIGS. 1 and 2.

DESCRIPTION OF THE INVENTION

Figure 1:
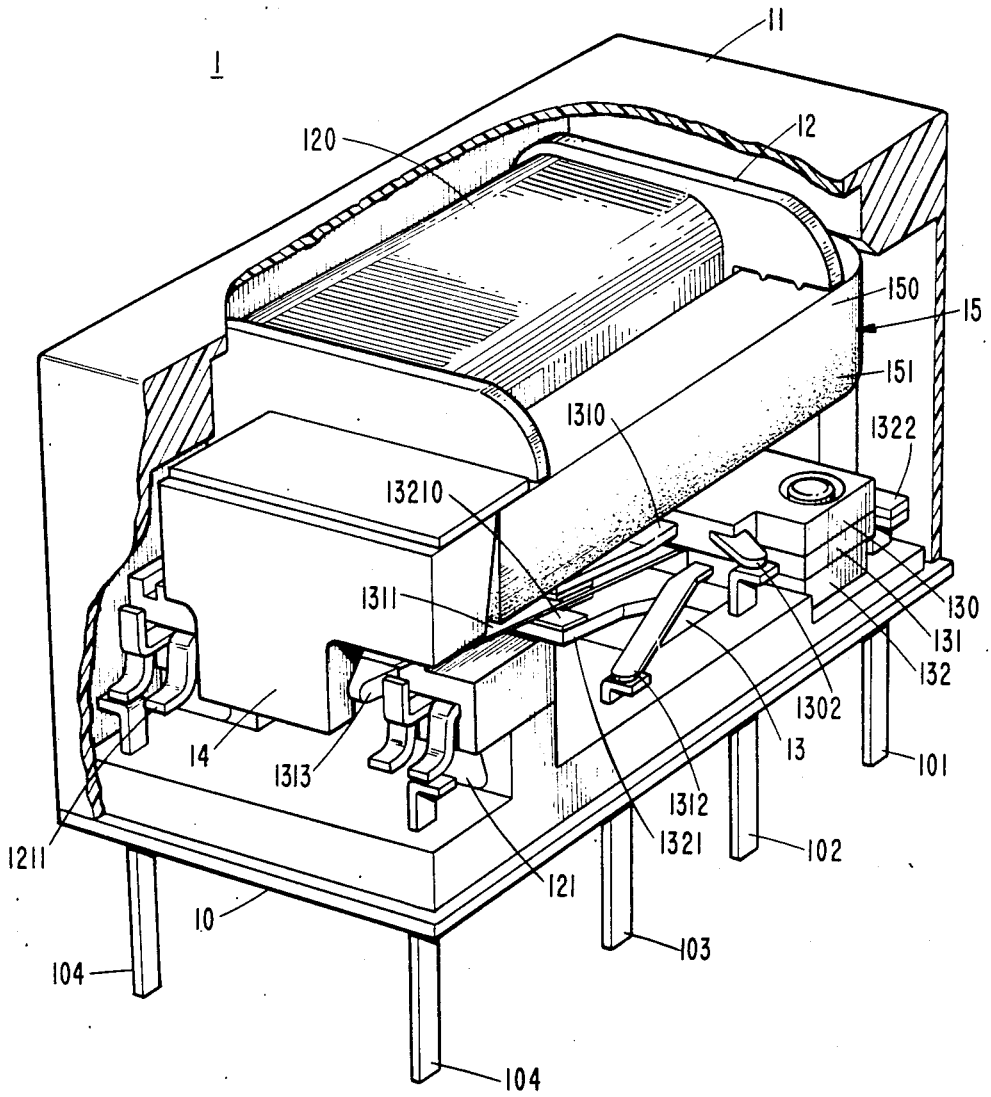
FIG. 1 depicts in perspective view an illustrative electromechanical relay according to the invention with an enclosing cover broken away to disclose various assembled operative elements embodying the principles of the instant invention.

Referring to the drawing, and more specifically to FIG. 1 of the drawing, the electromechanical relay set forth therein and hereinafter identified as relay 1 is a miniature relay intended for use in mounting on a circuit board and to function in operating circuitry both external to and located on the circuit board. Typically, an electromechanically relay, such as relay 1, has a base member 10 on which is mounted a ing assembly 13 having a number or contacts such as contact 13210. In addition, relay 1 has an armature 14 used to operate spring assembly 13 and an electromagnetic structure that is enabled by an electrical current applied to relay 1 to activate armature 14.

The relay electromagnetic structure of the illustrative embodiment of the present invention includes a magnetic core member 15 having a bobbin 12 positioned thereon on which is wound a coil 120 connected to terminals such as terminals 104 located on base member 10. In operation, an electrical current applied to coil terminals 104 generates a magnetic field that magnetizes magnetic core member 15 in a manner hereinafter described in detail to activate armature 14. The activation of armature 14 operates spring assembly 13 to engage and disengage contacts such as contacts 13210 that are connected with base member terminals 101, 102, 103 to control electrical circuitry connected with relay 1. A cover 11 is usually placed over the electromagnetic structure and spring assembly 13 and bonded to base member 10 to protect relay 1.

Referring now to FIG. 2 of the drawing, base member 10 may be formed of any one of a number of well-known insulating materials to have a generally rectangular configuration in which are mounted a number of terminals 101, 102, 103, 104. Base member 10 also has a pair of mounting embossments 105 and spring assembly mounting posts 106 used to mount and support bobbin 12 and spring assembly 13, respectively, on base member 10.

Spring assembly 13 may comprise either a pair of contact spring assemblies or a pileup of spring assemblies such as spring assemblies 130, 131, 132. A contact spring assembly such as lower contact spring assembly 132 has a support member 1320 formed of electrical insulating material in which is mounted a single or pair of contact springs 1321. Each contact spring 1321 has a contact 13210 that may be formed of a precious metal positioned on one end of contact spring 1321. Contact springs 1321 extend through support member 1320 with the end opposite contact 13210 formed into a contact terminal 1323. In assembly, support member 1320 is positioned on base member 10 with spring assembly mounting posts 106 extended through support member mounting holes 1322 and each contact terminal 1323 welded or affixed to a corresponding lower contact terminal 101.

Similarly, middle contact spring assembly 131 comprises a support member 1310 mounting a single or pair of flexible bifurcated contact springs 1311 each having a pair of contacts 13110 positioned in the center and on both sides of the bifurcated sections of contact springs 1311. A spring operate member 1313 made of an insulating material is affixed to the ends of contact springs 1311 and each contact spring 1311 extends through support member 1310 and is formed into contact terminal 1312. In assembly, middle contact spring assembly 131 is mounted on base member 10 on top of lower contact spring assembly 132 with mounting posts 106 extending through holes 1314 and contact terminals 1312 each welded or affixed to a corresponding middle contact terminal 103. Upper contact spring assembly 130 comprises a single or a pair of contact springs 1301 mounted in a support member 1300 having a rear vertical section 1304 with a bobbin mounting hole 1305 formed therein. Each contact spring 1301 has a contact 13010 located at one end and extends through support member 1300 into contact terminal 1302. Spring assembly 13 is completed by mounting support member 1300 onto base member mounting posts 106 with each contact terminal 1302 welded or affixed to a corresponding upper contact terminal 102.

Bobbin 12 is a generally cylindrical configured member formed of electrical insulating material to have a central aperture 1215 and a pair of flanges 1214 at each end thereof with each flange having a section 1213 cut therein such that the legs 153 of magnetic core member 15 may be inserted into flange sections, 1213 and into central aperture 1215. One flange 1214 has a pair of bobbin coil terminal assemblies 121 formed thereon with each bobbin coil terminal assembly 121 having a cavity 1210 for receiving a coil terminal 1211. The other flange 1214 has a bobbin mounting post 1216 extending outward therefrom. One or more coils 120 may be wound on bobbin 12 to encircle a leg 153 of magnetic core 15 with each end of the coil wire connected to a coil terminal 1211. A bottom portion 1212 of each bobbin coil terminal assembly 121 is inserted into base member embossments 105 and bobbin mounting post 1216 is inserted into bobbin mounting hole 1305 of upper contact assembly 130 to mount bobbin 12 and magnetic core 15 on base member 10. Each coil terminal 1211 is either welded or affixed in any of a number of well-known ways to a corresponding base member coil terminal 104.

Armature 14 is positioned in relay 1 with respect to pole areas 152 of magnetic core 15 and spring operate section 1313 so that contacts 13110 of middle contact spring assembly 131 remain in normal engagement with contacts 13010 of upper contact spring assembly 130. An electrical conducting path is thereby established between base terminals 102 and 103 through engaged contacts 13010 and 13110 of upper and middle contact spring assemblies 130 and 132.

Magnetic core 15 may be a generally U-shaped magnetic core member having a rectangular shaped cross-sectional area throughout and a pair of legs 153 each having a pole area 152 located at the end thereof. In one embodiment of the invention as set forth in FIG. 3 of the drawing, magnetic core 15 has a first horizontal region 151 formed of compressed soft magnetic powdered materials such as, although not limited thereto, a combination of nickel and iron. In assembly, magnetic core 15 is formed by placing the combined soft magnetic powdered materials 151 into a mold and compressing powdered materials 151 to form a generally U-shaped member. A second horizontal region 150 is formed by adding a combination of hard magnetic powdered materials such as aluminum, cobalt and iron to the mold on top of the compressed soft magnetic powdered material 151. Both the hard and soft magnetic powdered materials 150 and 151 are compressed and sintered thereby forming U-shaped magnetic member 15 having a generally rectangular shaped cross-sectional area thereout. The rectangular cross-sectional area is proportioned such that one-half is formed of the compressed soft magnetic powdered material 151 and the remaining one-half of the area formed of the compressed hard magnetic powdered material 150 with a fused boundary area separating each of the materials.

A pole area 152 is formed by the hard magnetic powdered material region 150 at each end of the legs 153. Magnetic flux generated by a pole area 152 is returned to the other pole area 152 through the fused boundary of the compressed hard magnetic powdered material 150 with the compressed soft magnetic powdered material 151 and through soft magnetic powdered material 151 such that little or no magnetic flux appears at the surface of pole area 152. When U-shaped core member 15 is assembled in combination with bobbin 12 and armature 14, FIG. 2 of the drawing, armature 14 is in a released state with spring operate section 1313 positioned such that contacts 13110 of middle contact spring assembly 131 are positioned in engagement with contacts 13010 of upper contact spring assembly 130. An electrical path is thereby established between middle contact terminals 103 and upper contact terminals 102 through engaged contacts 13110 and 13010.

When an electrical current is applied through coil terminals 104 to coil winding 120 encircling a portion of magnetic core member 15, soft magnetic powdered material 151 is magnetized in the same polarity as hard magnetic powdered material 150 thereby aiding pole areas 152 to generate magnetic flux sufficient to attract and activate armature 14. The activation of armature 14 moves spring operate section 1313 inward to bow middle contact spring assembly 1311 and disengage contacts 13110 from contacts 13010 of upper contact springs 1301 thereby opening the electrical path previously existing between middle and upper contact terminals 103 and 102. In addition, the bowing of middle contact spring assembly 1311 functions to engage contacts 13110 with contacts 13210 of lower contact assembly 1321 and establish an electrical path through lower and middle contact terminals 101 and 103. Removal of the electrical current from coil winding 120 returns soft magnetic powdered material 151 to the normal state providing a return path for the magnetic flux generated by pole areas 152 thereby releasing armature 14 to disengage contact 13110 from contact 13210 and re-engage contact 13110 with contact 13010.

Although relay 1 has been disclosed with lower, middle and upper contact spring assemblies 130, 131, 132, it is to be understood that spring assembly 13 could include upper and middle contact spring assemblies 130, 131 whereby the electrical current appearing in coil winding 120 would bow contact spring assembly 1311 to engage contacts 13110 with contacts 13010. In addition, spring assembly 13 could include lower and middle contact spring assemblies 132, 131 whereby the electrical current appearing in coil winding 120 would bow contact spring assembly I311 to disengage contacts 13110 with contacts 13210.

In another embodiment of the invention set forth in FIG. 4 of the drawing, magnetic core member 15 may be a U-shaped magnetic core member 155 formed of compressed hard and soft magnetic powdered materials 1505 and 1515. U-shaped magnetic core member 155 is formed to have a generally rectangular cross-sectional area throughout proportioned to have twenty to thirty-five percent of the area formed of a compressed soft magnetic powdered material 1515. The remaining eighty to sixty-five percent, respectively, of the cross-sectional area is formed of a compressed hard magnetic powdered material 1505 sintered onto the compressed soft magnetic powdered material 1515 thereby forming a fused boundary between the hard and soft magnetic powdered materials and oversized pole areas 1525 at each end of legs 1535.

Referring now to FIGS. 2 and 4 of the drawing, U-shaped magnetic core 155 may be substituted for U-shaped magnetic core 15 in relay 1 to make what is referred to as a latch relay. When an electrical current is applied to coil winding 120, soft magnetic powdered material 1515 is magnetized so as to aid pole areas 1525 to generate sufficient flux to activate armature 14 to engage lower ones of contacts 13110 and 13210. When the electrical current is removed from winding 120, only a part of the magnetic flux 1555 is returned through the fused boundary and the demagnetized small amount of soft magnetic powdered material 1515. The remaining part of magnetic flux 1555 appearing at pole areas 1525 holds previously activated armature 14 latched against pole areas 1525 thereby maintaining contacts 13110 engaged with contacts 13210 even though the electrical current has been removed from coil winding 120.

In another embodiment of the invention, a reverse electrical current may be applied to coil winding 120 to magnetize soft magnetic powdered material 1515 in an opposite direction so as to generate additional magnetic flux that opposes magnetic flux 1555 generated by pole areas 1525. Armature 14 is thereby released disengaging middle contact spring assembly contacts 13110 with lower contact spring assembly contacts 13210. Release of armature 14 also enables contacts 13110 of middle contact spring assembly 131 to engage upper contact spring assembly contacts 13010. In yet another embodiment of the invention, another coil winding, not shown in the drawing, may be wound around bobbin 12 in such a direction that an electrical current applied thereto may magnetize soft magnetic powdered material 1515 in the aforementioned direction to affect the release of latched armature 14.

The use of U-shaped magnetic core 15, FIG. 2 of the drawing, having hard magnetic powdered material 150 sintered onto and forming a fused boundary with soft magnetic powdered material 151 for controlling the amount of magnetic flux appearing at pole areas 152, requires less electrical operating current and thereby improves the operating sensitivity of electromechanical relay 1 thereby allowing a reduction in the size of relay 1.

SUMMARY

It is obvious from the foregoing that the facility, economy and efficiency of electromechanical relays may be substantially enhanced by a magnetic core member having hard magnetic powdered materials superimposed on soft magnetic powdered materials intended to return magnetic flux generated by pole areas formed at ends of the magnetic core member. It is further obvious that a fused boundary formed of hard magnetic powdered materials sintered onto soft magnetic powdered materials to form the fused boundary for controlling the exchange of magnetic flux between pole areas improves the operating sensitivity of small electromechanical relays.

What is claimed is:

1. An electromechanical relay (1) having an armature (14) and a spring assembly (13) mounting contacts comprising electromagnetic means (12, 15) for activating said armature to operate said spring assembly to engage and disengage said contacts characterized in that said electromagnetic means comprises means (15) having a first region formed of a soft magnetic material (151) and a second region formed of a hard magnetic material (150) superimposed on said soft magnetic material forming pole areas (152) with magnetic flux generated by said pole areas normally returned through said soft magnetic material and enabled by an electrical current in a coil winding (120) encircling said electromagnetic means for magnetizing said soft magnetic material to aid said pole areas in activating said armature.

2. The electromagnetic relay set forth in claim 1 characterized in that said electromagnetic means comprises a member (15) having said first region formed of a compressed soft magnetic powdered material (151) and said second region formed of a compressed hard magnetic powdered material (150) for forming said pole areas at ends of said member and a fused boundary return path for said magnetic flux normally generated by said pole areas.

3. The electromagnetic relay set forth in claim 2 characterized in that said electromagnetic means comprises a generally U-shaped magnetic core member (15) having a first horizontal region formed of said soft magnetic powdered material (151) and a second horizontal region formed of said hard magnetic powdered material (150) sintered to said soft magnetic powdered material and forming a pair of said vertical pole areas (152) one at each end of said U-shaped member with said magnetic flux generated by one of said pole areas normally returned through said fused boundary of said U-shaped member to said other pole area and enabled by said encircling coil for magnetizing said soft magnetic powdered material to aid said pole areas for activating said armature.

4. The electromagnetic relay set forth in claim 3 characterized in that said U-shaped magnetic core means comprises a generally rectangular shaped cross-sectional area proportioned to have one-half said soft magnetic powdered material (151) and one-half said hard magnetic powdered material (150) sintered onto said soft magnetic powdered material for forming said fused boundary and said pole areas for activating and deactivating said armature in response to said electrical current applied and removed from said coil winding.

5. The electromagnetic relay set forth in claim 3 characterized in that said U-shaped magnetic core means (155) comprises a generally rectangular shaped cross-sectional area proportioned to have twenty to thirty-five percent said soft magnetic powdered material (1515) and eighty to sixty-five percent hard magnetic powdered material (1505), respectively, with said hard magnetic powdered material sintered onto said soft magnetic powdered material forming oversized ones of said pole areas (1525) normally generating magnetic flux for latching said previously activated armature in a position to hold operated said spring assembly in the absence of said electrical current in said coil winding and for releasing said latched armature in response to a reversed polarity electrical current applied to said coil winding.

6. An electromechanical relay (1) having an armature (14) and a spring assembly (13) mounting contacts comprising electromagnetic means (12, 15) for activating said armature to operate said spring assembly to engage and disengage said contacts characterized in that said electromagnetic means comprises a generally U-shaped magnetic core member (15) having a first horizontal region formed of a compressed soft magnetic powdered material (151) and a second region formed of a compressed hard magnetic powdered material (150) sintered onto said compressed soft magnetic powdered material for forming a pole area (152) at each end of said U-shaped magnetic core member with magnetic flux generated by said pole areas normally returned through a fused boundary of said compressed soft magnetic powdered material with said compressed hard magnetic powdered material and wherein said U-shaped magnetic core is enabled by an electrical current in a coil winding (120) encircling a section thereof for magnetizing said compressed soft magnetic powdered material to aid said pole areas in activating said armature.

7. An electromechanical relay (1) having a spring assembly (13) mounting contacts comprising an armature (14) for bowing said spring assembly to engage and disengage said contacts, and electromagnetic means (12, 15) for activating said armature characterized in that said electromagnetic means comprises a U-shaped magnetic core member (15) having a generally rectangular shaped cross-sectional area throughout proportioned to have one-half of said area formed of a compressed soft magnetic powdered material (151) and the remaining one-half of said area formed of a compressed hard magnetic powdered material (150) sintered onto said soft magnetic powdered material for forming a pole area (152) at each end of said U-shaped magnetic core member with the magnetic flux generated by said pole areas normally returned through a fused boundary of said compressed soft magnetic powdered material with said compressed hard magnetic powdered material and wherein said U-shaped magnetic core is enabled by an electrical current in a coil winding (120) encircling a section thereof for magnetizing said compressed soft magnetic material to aid said pole areas in activating said armature.

8. An electromechanical relay (1) having a spring assembly (13) mounting contacts comprising an armature (14) for bowing said spring assembly to engage and disengage said contacts, and electromagnetic means (12, 15) for activating said armature characterized in that said electromagnetic means comprises a U-shaped magnetic core member (155) having a generally rectangular shaped cross-sectional area throughout proportioned to have twenty to thirty-five percent of said area formed of a compressed soft magnetic powdered material (1515) and eighty to sixty-five percent of said area formed of a compressed hard magnetic powdered material (1505), respectively, with said hard magnetic powdered material sintered onto said soft magnetic powdered material forming oversized pole areas (1525) at each end of said U-shaped magnetic core member generating magnetic flux for latching the armature previously activated by an electrical current in a coil winding (120) encircling a section thereof in an activated state in the absence of said electrical current and for releasing said latched armature in response to a reversed polarity electrical current applied to said coil winding.

9. An electromechanical relay (1) having a spring assembly (13) mounting contacts comprising an armature (14) for bowing said spring assembly to engage and disengage said contacts, and electromagnetic means (12, 15) having first and second coil windings encircling a portion thereof for activating and deactivating said armature in response to an electrical current applied to said first and second coil windings characterized in that said electromagnetic means comprises a U-shaped magnetic core member (155) having a generally rectangular shaped cross-sectional area throughout proportioned to have twenty to thirty-five percent of said area formed of a compressed soft magnetic powdered material (1515) and eighty to sixty-five percent of said area formed of a compressed hard magnetic powdered material (1505), respectively, with said hard magnetic powdered material sintered onto said soft magnetic powdered material forming oversized pole areas (1525) at each end of said U-shaped magnetic core member generating magnetic flux for latching the armature activated by said electrical current previously applied to said first coil winding and for releasing said latched armature in response to said electrical current applied to said second coil winding.

10. Electromagnetic apparatus comprising a U-shaped magnetic core member (15) having a generally rectangular shaped cross-sectional area throughout proportioned to have one-half of said area formed of a compressed soft magnetic powdered material (151) and the remaining one-half of said area formed of a compressed hard magnetic powdered material (150) sintered onto said soft magnetic powdered material for forming a fused boundary therewith and a pole area (152) at each end of said U-shaped magnetic core member with magnetic flux generated by said pole areas normally returned through said fused boundary of said compressed soft magnetic powdered material with said compressed hard magnetic powdered material and wherein said U-shaped magnetic core is enabled by an externally generated magnetic force for magnetizing said compressed soft magnetic powdered material to aid said pole areas in generating additional magnetic flux.

11. Electromagnetic apparatus comprising a U-shaped magnetic core member (155) having a generally rectangular shaped cross-sectional area throughout proportioned to have twenty to thirty-five percent of said area formed of a compressed soft magnetic powdered material (1515) and eighty to sixty-five percent of said area formed of a compressed hard magnetic powdered material (1505), respectively, with said hard magnetic powdered material sintered onto said soft magnetic powdered material forming oversized pole areas (1525) at each end of said U-shaped magnetic core member for generating magnetic flux and a fused boundary with said magnetic flux generated by one pole area returned through said fused boundary and said soft magnetic powdered material to the other pole area and enabled by external generated magnetic forces for magnetizing said soft magnetic powdered material for aiding and opposing said pole areas in generating said magnetic flux.

* * * * *